US010633182B2

(12) United States Patent
Musso et al.

(10) Patent No.: US 10,633,182 B2
(45) Date of Patent: Apr. 28, 2020

(54) THREE COMPARTMENT REAR LOAD PACKER

(71) Applicant: Air-Flo Manufacturing Co., Inc., Elmira Heights, NY (US)

(72) Inventors: Tom W. Musso, Bath, NY (US); Charles S. Musso, Jr., Corning, NY (US)

(73) Assignee: Air-Flo Manufacturing Co., Inc., Elmira Heights, NY (US)

( * ) Notice: Subject to any disclaimer, the term of this patent is extended or adjusted under 35 U.S.C. 154(b) by 92 days.

(21) Appl. No.: 15/568,621

(22) PCT Filed: May 13, 2016

(86) PCT No.: PCT/US2016/032432

§ 371 (c)(1),
(2) Date: Oct. 23, 2017

(87) PCT Pub. No.: WO2016/187031

PCT Pub. Date: Nov. 24, 2016

(65) Prior Publication Data

US 2018/0155125 A1 Jun. 7, 2018

Related U.S. Application Data

(60) Provisional application No. 62/161,996, filed on May 15, 2015, provisional application No. 62/174,748, filed on Jun. 12, 2015.

(51) Int. Cl.
*B65F 3/20* (2006.01)
*B65F 3/00* (2006.01)
(Continued)

(52) U.S. Cl.
CPC ..... *B65F 3/208* (2013.01); *B65F 3/001* (2013.01); *B65F 3/28* (2013.01); *B65F 3/24* (2013.01)

(58) Field of Classification Search
CPC ..... B65F 3/208; B65F 3/001
See application file for complete search history.

(56) References Cited

U.S. PATENT DOCUMENTS 3,878,949 A 4/1975 Colin
3,961,717 A 6/1976 Sabine
(Continued)

OTHER PUBLICATIONS

"Greener Advantage", Retrieved from http://www.roystrom.com/print/94, 2017, 1 page.

*Primary Examiner* — Jonathan Snelting
(74) *Attorney, Agent, or Firm* — Alix, Yale & Ristas, LLP

(57) ABSTRACT

A multi-compartment, sweeper-type rear loading refuse packer, in which a single pack blade is pivotally connected to a multi-section sweep blade. Only a single pack blade is needed to move all the sections of the sweep blade toward the compartments. As the type of refuse in each compartment is different and must be offloaded separately, especially in a three-compartment system, two anti-spill plates are provided for selective blocking of the lower portion of the outer two compartments. Seal plates can also be provided for selective blocking of the upper portion of the outer two compartments, whereby an anti-spill plate and paired seal plate confront and close the opening of the associated refuse compartment when the compaction unit is pivoted to the ejection position.

15 Claims, 14 Drawing Sheets

(51) Int. Cl.
*B65F 3/28* (2006.01)
*B65F 3/24* (2006.01)

(56) References Cited

U.S. PATENT DOCUMENTS

| | | | | |
|---|---|---|---|---|
| 4,057,154 | A | 11/1977 | Neufeldt | |
| 4,460,307 | A * | 7/1984 | Durant | B65F 3/20 414/525.54 |
| 5,123,801 | A | 6/1992 | O'Daniel | |
| 7,118,320 | B2 * | 10/2006 | Tomassoni | B65F 3/001 414/517 |
| 2005/0220593 | A1 | 10/2005 | MacPherson | |
| 2006/0045700 | A1 * | 3/2006 | Siebers | B65F 3/208 414/509 |
| 2014/0348621 | A1 | 11/2014 | Brisson | |

* cited by examiner

THREE COMPARTMENT REAR LOAD PACKER

RELATED APPLICATIONS

The present application claims the benefit of the filing date under 35 U.S.C. § 119(e) of U.S. Provisional Application No. 62/161,996 filed May 15, 2015 for "Three Compartment Rear Load Packer" and U.S. Provisional Application No. 62/174,748 filed Jun. 12, 2015 for "Three Compartment Refuse Packer with Anti-Spill Plates", the disclosures of which are hereby incorporated by reference.

BACKGROUND

The present invention relates to trucks for refuse packing, and especially to truck bodies adapted to pack recyclable refuse.

Some communities desire the separate recycling of three kinds of materials: metals, paper goods, and organics. Although truck bodies are known for providing three compartments for receiving, packing, and ejecting three types of recyclables, such bodies have one sump, one sweep blade and one pack blade for each compartment, with two compartments loaded from the rear of the body and one compartment loaded from the sidewalk side of the body. This configuration has two main disadvantages. First, three sets of power and actuation components are required, with the resultant high cost of components and encroachments on available space for the packing compartments. Second, curbs, poles, signs and other roadside obstacles can inconvenience and endanger the collection worker at the side sump.

SUMMARY

The present invention is generally directed to a multi-compartment, sweeper-type rear loading refuse packer for a truck body, wherein a single pack blade cooperates with a multi-section sweep blade.

The sweep blade can be unitary, with multiple sections connected together and driven as a unit or the sweep blades can be segmented, with each driven individually.

This enables the collection worker to separately load all three types of recyclables at the rear of the truck, and reduces the number and space occupied by the power and actuation components.

In a three compartment configuration, the sweep blade has two spaced apart slots which cooperate with a respective two collection sump dividers that extend to the openings of the compartments. This defines three collection sumps and three channels leading into a respective three longitudinal packing compartments. With a unitary sweep blade option, the blade comprises opposed top and bottom continuous edges of greater lengths than opposed lateral edges, with an optional curvature from top to bottom, and with laterally spaced slots extending at least halfway from the bottom edge toward but not reaching the top edge. With a segmented sweep blade, the slots extend the full blade height from top to bottom. The sweep blade spans all the collection sumps from above and the two vertical slots are laterally spaced at a distance corresponding to the lateral space between the compartment dividing walls, thereby defining three blade sections drivable toward through the collection sumps toward the loading floors of the compartments.

Yet another embodiment is directed to a rear load refuse body comprising three packer compartments extending longitudinally from the front toward the back of the body; three laterally divided collection sumps at the lower back of the body, for receiving a respective three loads of segregated refuse; and a sweep blade extending laterally across all the sumps, with three sections corresponding to the three collection sumps. The sweep blade sections are movable respectively within each sump. A first drive system is provided for sweeping the entire sweep blade whereby each sweep blade section sweeps through each respective collection sump and thereby transports collected refuse toward the floor of a respective compartment. A single pack blade is coupled to the sweep blade and driven by a second drive system. As the pack blade is displaced obliquely, it lifts the sweep blade obliquely such that the sweep blade and pack blade push the collected refuse into respective compartments, against compaction faces carried on respective ejection cylinders in the compartments.

In an ideal three compartment system, cost and space are minimized when the sweep blade is unitary with three sections and the first drive system for the sweep blade has only two hydraulic cylinders, but space savings are still achieved even when the sweep blade has three segments driven by a respective three cylinders. In both embodiments, space savings are achieved by the use of a single pack blade, with the associated second drive system consisting of two hydraulic cylinders.

As used herein, the terms "multiple" and "multi" mean "at least two", and description of a compaction unit having multiple collection sumps or sweep blade having multiple sections according to the invention does not necessarily preclude the compaction unit from including an additional sweep blade and associated collection sump. The main advantage of the present invention is that for a compaction unit having a particular number of collection sumps with associated sweep blade sections, efficient operation can be achieved with fewer pack blades than the number of sweep blade sections. For example, in a hybrid three compartment packer, the compaction unit can have one conventional sump, sweep blade with dedicated drive, and pack blade with dedicated drive, in side-by-side combination with two other sumps having a two-section sweep blade and single pack blade according to one aspect of the invention. The inventive two-section sweep blade could be unitary or segmented, have either one or two associated drives, but with a single pack blade. Instead of the drive systems requiring six drives, only four or five drives would be required. This hybrid configuration would fall within the open-ended recitation of a multi-compartment, sweeper-type rear loading refuse compaction unit for a truck body, comprising a single pack blade pivotally connected to a multi-section sweep blade.

Another problem arises when the compaction unit is raised open for refuse ejection of the three compartments. There is a tendency for refuse in all three compartments to start dropping. This is undesirable, as the type of refuse in each compartment is different and must be offloaded separately. According to another improvement, this problem is solved by providing a sloped lower back end to the refuse compartments and two anti-spill plates cooperating with the sloped back end for blocking the lower portion of the outer two compartments. The two anti-spill plates hold the contents within the outside compartments, thus enabling the center compartment to be ejected first. Once the center compartment is unloaded, each of the outside compartments is uncovered in turn by lowering the respective anti-spill plate.

In a further feature to prevent spillage through the rear opening of one or more compartments, each having upper region and a lower regions, the anti-spill plate associated with a sump is displaceable to cover the lower region of the opening, and a seal plate is mounted on the body in vertical opposition to each anti-spill plate, to selectively cover the upper region of the opening. In the way the anti-spill plate and the seal plate confront and close the opening of the associated refuse compartment when the compaction unit is pivoted to the ejection position.

The anti-spill plates and seal plates can be advantageously used with any type of seep and pack blade configuration. Thus, an aspect of the invention is directed to a refuse truck having a refuse receiving body including a front, a back, a top, and a bottom, with at least one refuse compartment with an opening accessible at the back of the body, comprising; an anti-spill plate supported by the body, and rotatable between an open position away from a lower region of the opening and a closed position against the lower region of the opening; and a seal plate supported by the body, and rotatable between an open position away from an upper region of the opening and a closed position against the upper region of the opening.

The inventive principles described herein can be readily implemented in two, three, four or more compartment configurations.

DETAILED DESCRIPTION

Figure 1:
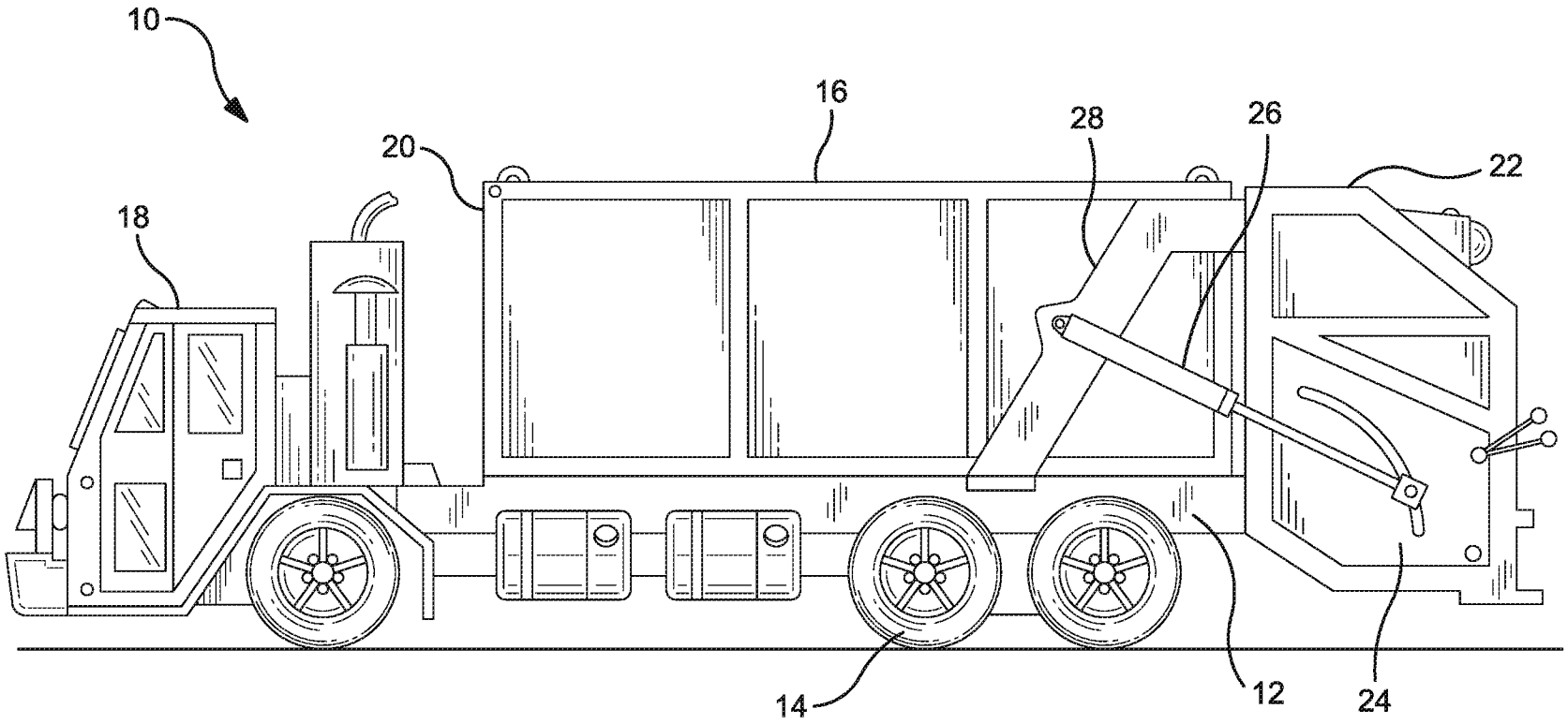
FIG. 1 PRIOR ART
FIG. 1 shows a conventional single compartment, rear-loading garbage packing truck.

FIG. 1 shows a conventional single compartment, rear-loading garbage truck 10, including chassis 12, wheels 14, body 16, and cab 18. The body extends longitudinally from a front end 20 to a back end 22, where a compaction unit 24 is integral with the body or supported by the chassis or both the body and chassis. Hydraulic cylinders 26 are mounted to the body or other support structure 28 to operate the compaction unit.

Figure 2:
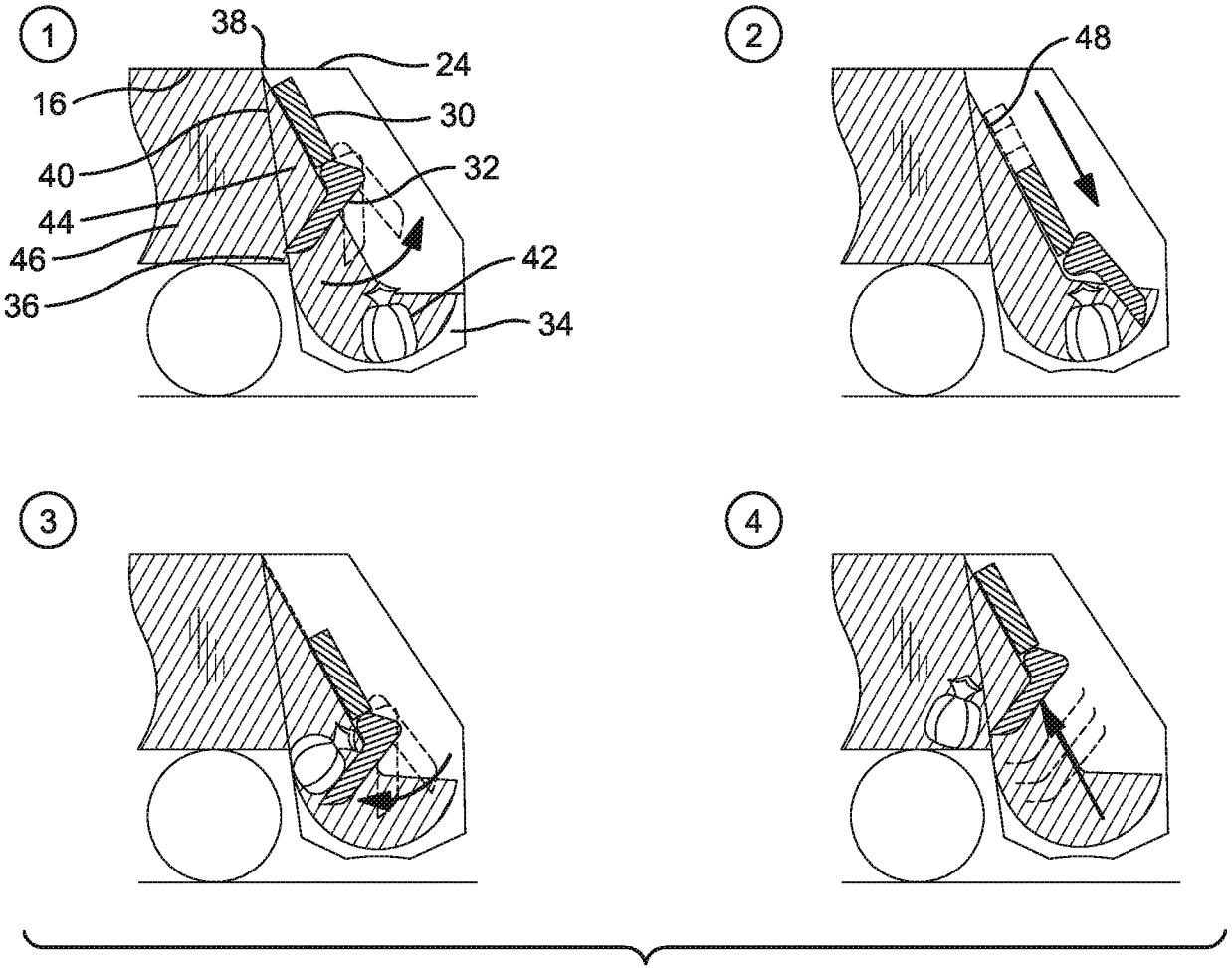
FIG. 2 PRIOR ART
FIG. 2 is a schematic representation of the steps in a packing cycle according to the present invention.

FIG. 2 is a schematic representation of the steps 1-4 in a packing cycle according to the present invention, which is directed to a sweep type compaction unit that can be incorporated into the overall truck and body represented in FIG. 1. The set of hydraulic cylinders 26 at the periphery of the body 16 can be adapted to operate the pack blade 30 and another set of cylinder (not shown) operate the sweep blade 32 through sump 34 into the pack compartment in body 16. The upper edge of the sweep blade 32 is pivotally connected along a transverse axis, to the bottom edge of the pack blade 30. The present invention is an improved truck body or compaction unit with efficient multi-compartment capability.

Figure 3:
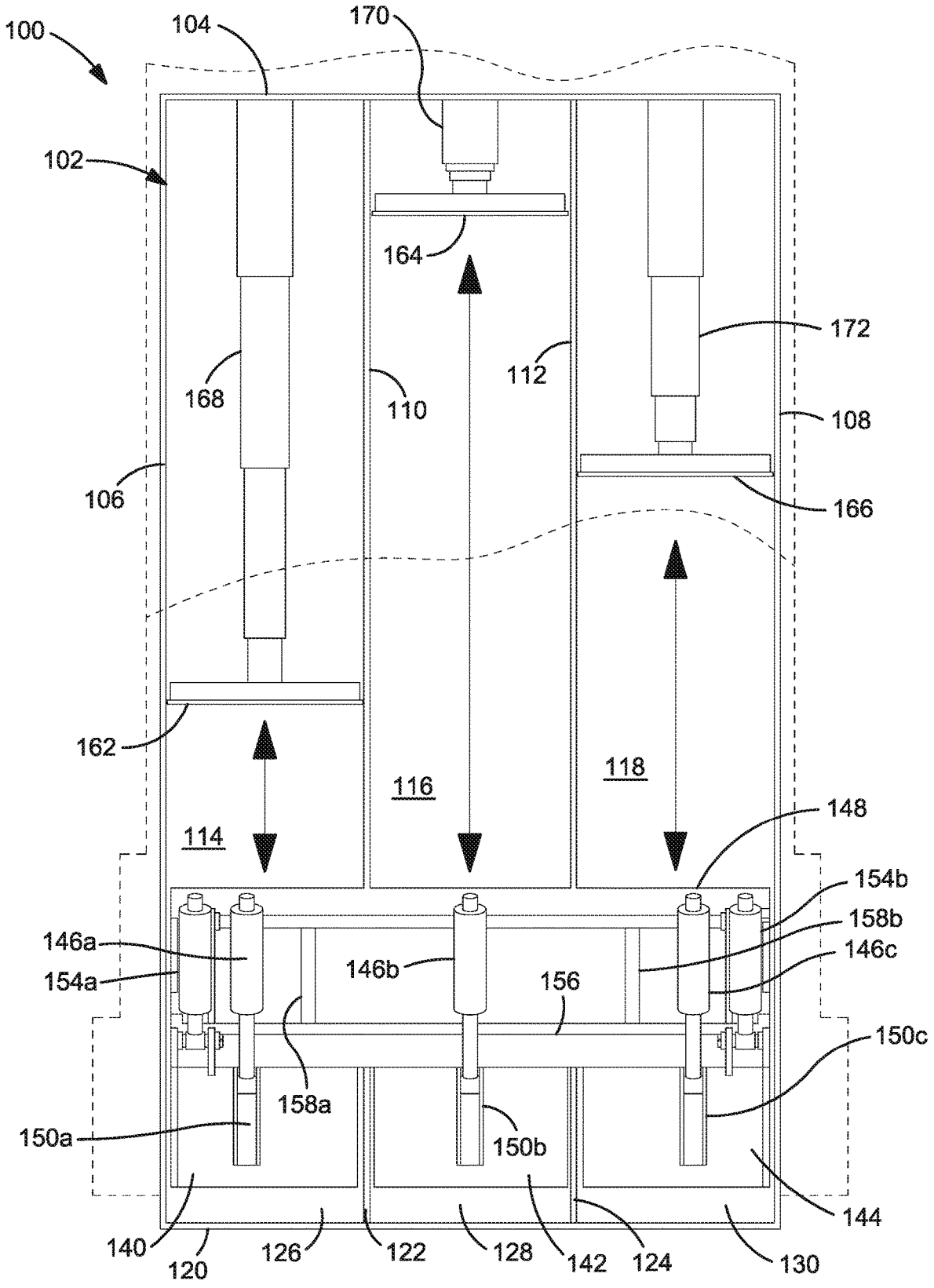
FIG. 3 is a top view of one embodiment of the present invention, showing the truck body with the roof removed.
Figure 4:
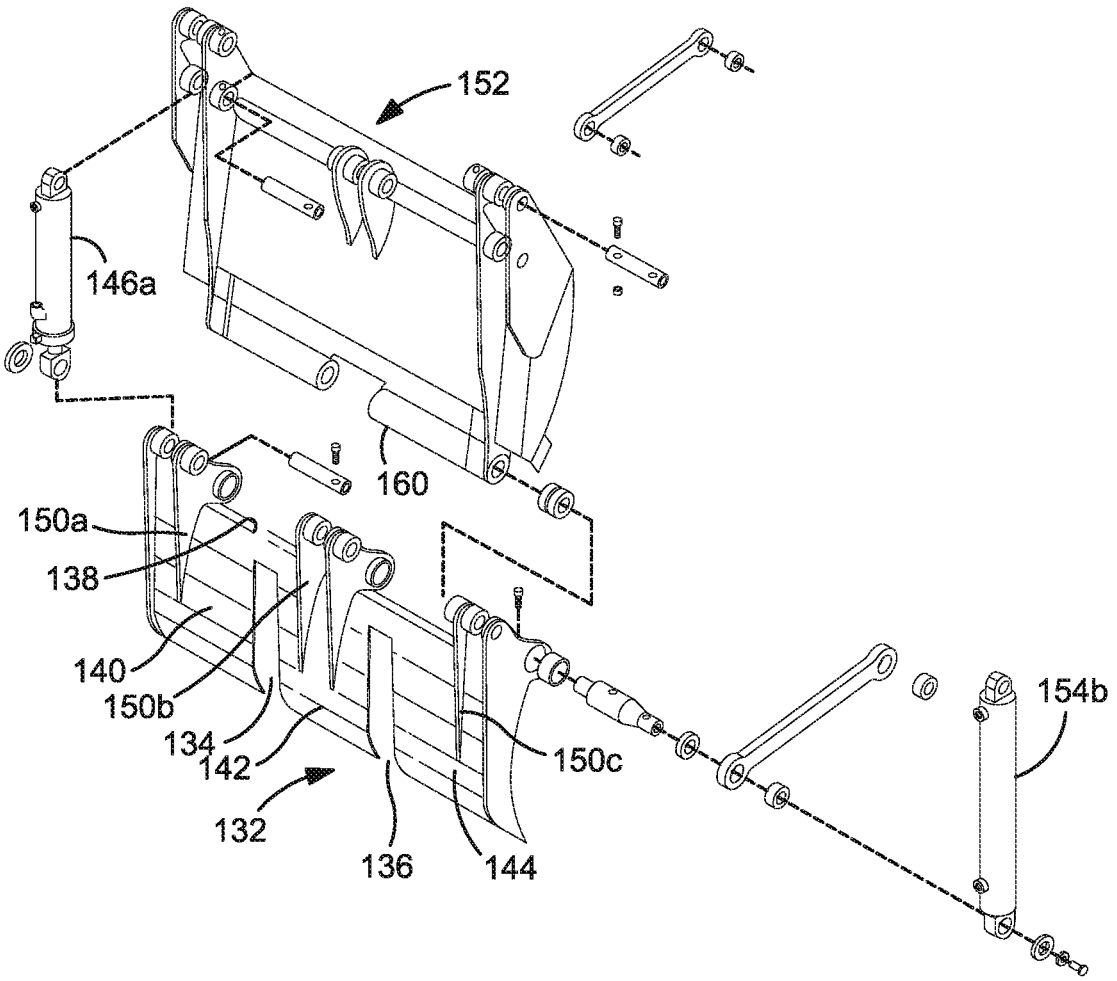
FIG. 4, is an exploded view showing the sweep blade as an integral unit that extends laterally the full width of the truck body and has two laterally spaced slits which extend vertically from the bottom edge of the blade at least half way to but terminating below the top edge of the blade.

FIGS. 3 and 4 will be described below, for showing the detailed execution of the inventive concept for three packer compartments extending longitudinally from the front toward the back of the body, but the general operating principles will be described with respect to FIG. 2. Each compartment has a height defined between a loading floor 36 and a ceiling 38, at a rear opening 40. Three collection sumps 34 at the back of the body, situated rearward of and below the compartment openings 40, receive a respective three loads 42 of segregated refuse (per steps 1 and 2 of FIG. 2). Two laterally spaced divider walls 44 extend from the sumps to the ceilings of the compartments at the compartment openings, thereby defining three respective loading channels from the sumps to the compartments. The main body has two longitudinal walls 46 aligned with the divider walls 44. Sweep blade 32 extends laterally across all the sumps 34, and has three sections corresponding to the three collection sumps, wherein the sweep blade sections are movable respectively within each sump.

A first drive system is provided for pivoting each sweep blade section through each respective collection sump toward the floor of a respective the compartment (as shown in step 3 of FIG. 2). A single pack blade 30 is displaceable in a linear oblique path toward and away from the sump 34. The pack blade is retracted upwardly and the sweep blade pivoted toward the floor 36 for collection of refuse (per step 1 of FIG. 2). The pack blade 30 is extended and the sweep blade is also extended in substantial alignment with the pack blade, and then pivoted toward the floor 36 in a sweeping action as shown in steps 2 and 3 of FIG. 2. As shown in step 4 of FIG. 2, the pack blade 30 is then retracted and in cooperation with the perpendicularly angled sweep blade 32, pushes the swept refuse through the channels between divider walls 44 into compartment openings 40 while maintaining segregation of the refuse between the divider walls. The rearward edges 48 of divider walls 44 are positioned and inclined so that the oblique upward displacement of the pack blade 30 closely follows the edges of the divider walls.

It can be appreciated that the pack blade has a lower edge that is pivotally connected along a transverse axis to an upper edge of the sweep blade; a first drive system pivots the sweep blade around the transverse axis, over an included angle that follows the shape of the sump; and a second drive system displaces the pack blade with sweep blade obliquely from the sump to the floors of the compartments.

FIG. 3 is a top view of one embodiment of the present invention, showing the truck body 100 with the roof removed. The body has a frame 102 with front wall 104 and side walls 106, 108. Two laterally spaced internal walls 110, 112 cooperate with the side and front walls to define three longitudinally extending packing compartments 114, 116, 118. At the back end 120, two longitudinally extending, laterally spaced dividers 122, 124 align with the walls 110, 112, respectively. The dividers separate three distinct collection sumps 126, 128, 130. The dividers 122, 124, extend or are otherwise connected to the walls 110, 112, so that three channels are formed, each having an associated sump and packing compartment.

As also shown in FIG. 4, the sweep blade 132 is an integral unit that extends laterally the full width of the body and has two laterally spaced slits 134, 136 which extend vertically from the bottom edge of the blade at least half way to but terminating below the top edge 138 of the blade. This defines three sweep blade sections 140, 142, 144, preferably having a curvature adapted to sweep within the respective three curved collection sumps 126, 128, and 130 as the slits 134, 136 pass over dividers 122, 124. In this manner, a different type of recyclable can be placed in a different collection sump, and separately swept toward respective packer compartments 114, 116, and 118 as the respective sweep blade cylinders 146*a*, 146*b*, and 146*c* sweep the entire sweep blade 132. Three sweep blade cylinders are shown but fewer can be provided. The sweep blade cylinders are supported within the frame on cross brace 148, with linkages and associated actuation arms 150*a*, 150*b*, and 150*c* connected to the back side, for sweeping blade 132.

The pack blade 152 extends laterally across the body above the sweeper blade 132, for oblique movement toward and away from the compartments. Pack blade cylinders 154*a*, 154*b* are shown mounted inside the body or frame for this purpose and connect to an additional cross brace 156, but the pack blades can alternatively be mounted outside the frame. Braces 158*a*, 158*b* are also provided. The lower edge 160 of the packer blade is in essence pivotally connected along a transverse axis to the upper edge 138 of the sweep blade for cooperative movement as described with respect to FIG. 2.

Refuse in each compartment 114, 116, 118 is packed as the pack blade 30, 152 and sweep blade 32 as sectioned per 140, 142, 144, push the refuse into the openings 40 at the rear of the compartments. The refuse is pushed against packing faces 162, 164, 166 on the ejection cylinders 168, 170, 172. The cylinders retract as the compartments fill with packed refuse. When the truck is full, the entire compaction unit 24 (FIG. 2) rotates upwardly to expose the compartment openings 40. The ejection cylinders 168, 170, 172 are extended in sequence to push the refuse out the back end of the truck into three different dumping stations for the respective three different kinds of refuse.

Figure 5:
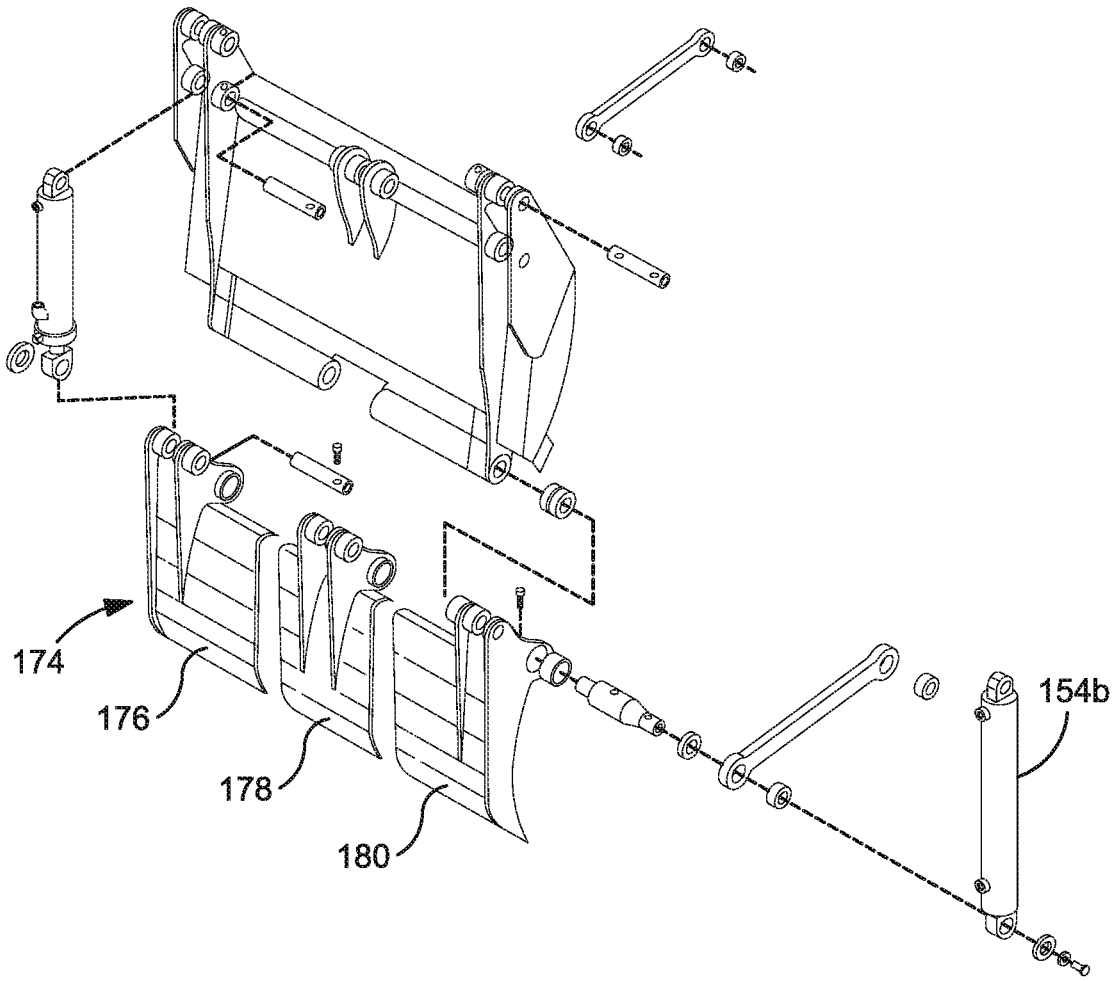
FIG. 5 shows another embodiment for the sweep blade.

FIG. 5 shows another embodiment 174 for the sweep blade. Each of the three sections is a distinct segment 176, 178, 180. In all other respects, the relationship and cooperation with the pack blade are the same as described with respect to FIGS. 2-4. It should be understood that, as shown in FIG. 5, the present description of the upper edge of the sweep blade as being pivotally connected to the lower edge of the pack blade does not require literal mating on the edges or effective along the entire lateral extent of the edges. The main point is that the blades are connected so that the edges pivot.

Regardless of the number of compartments, sweep blade sections or segments, and sweep blade cylinders, only one pack blade is required, which can be actuated by only two internal or external cylinders.

When the compaction unit 24 is raised open for refuse ejection of the three compartments, there is a tendency for all three compartments to start spilling refuse. This is undesirable, as the type of refuse in each compartment is different and must be offloaded separately.

Figure 6:
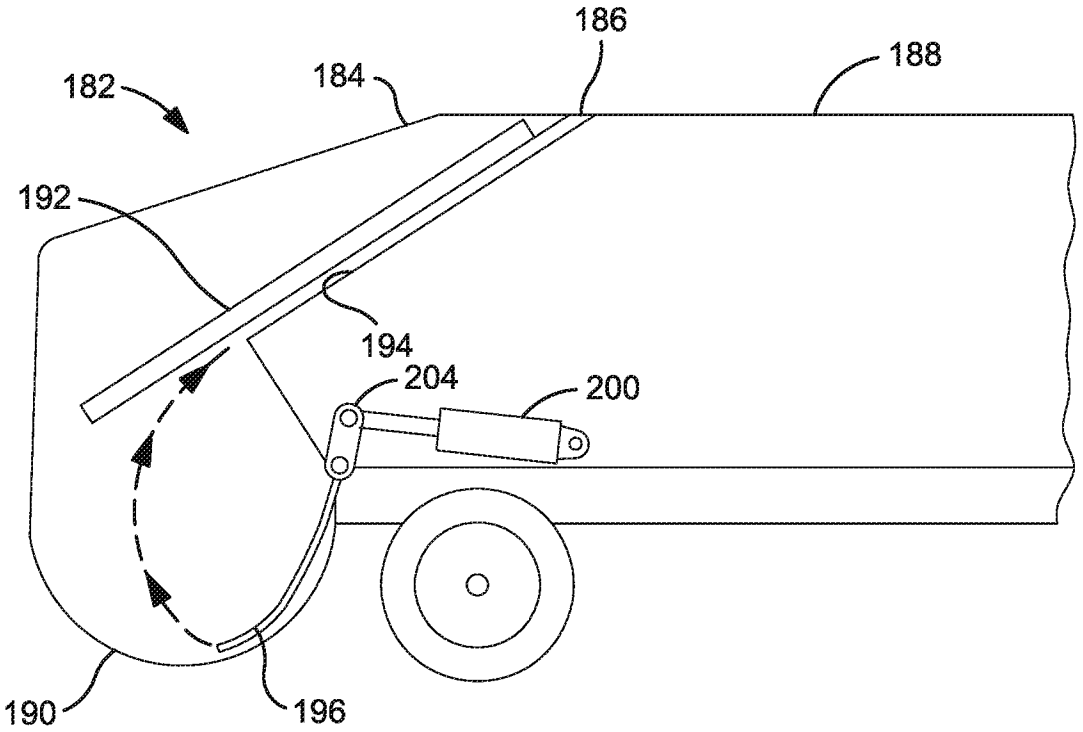
FIGS. 6 and 7 schematically show the operation of anti-spill plates.
Figure 7:
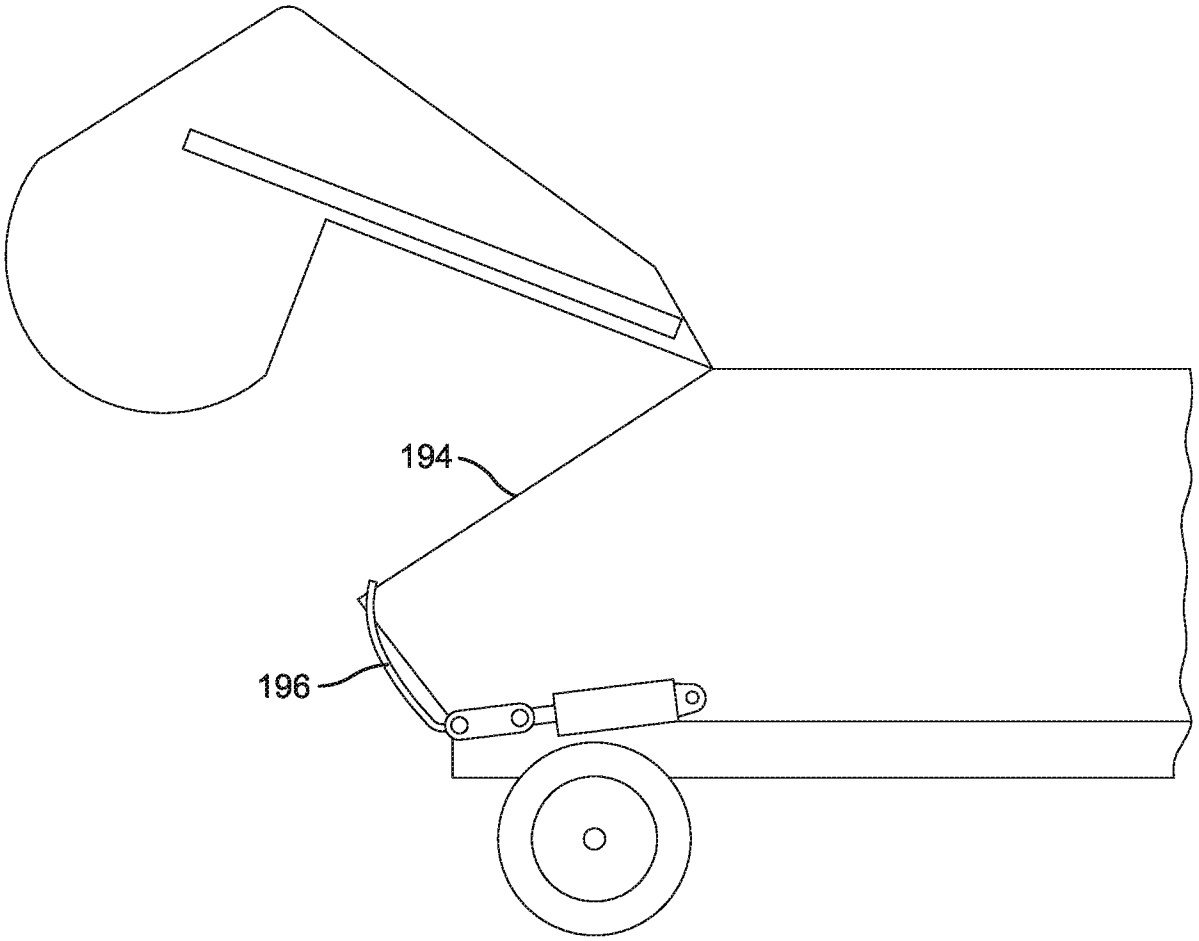
Figure 8:
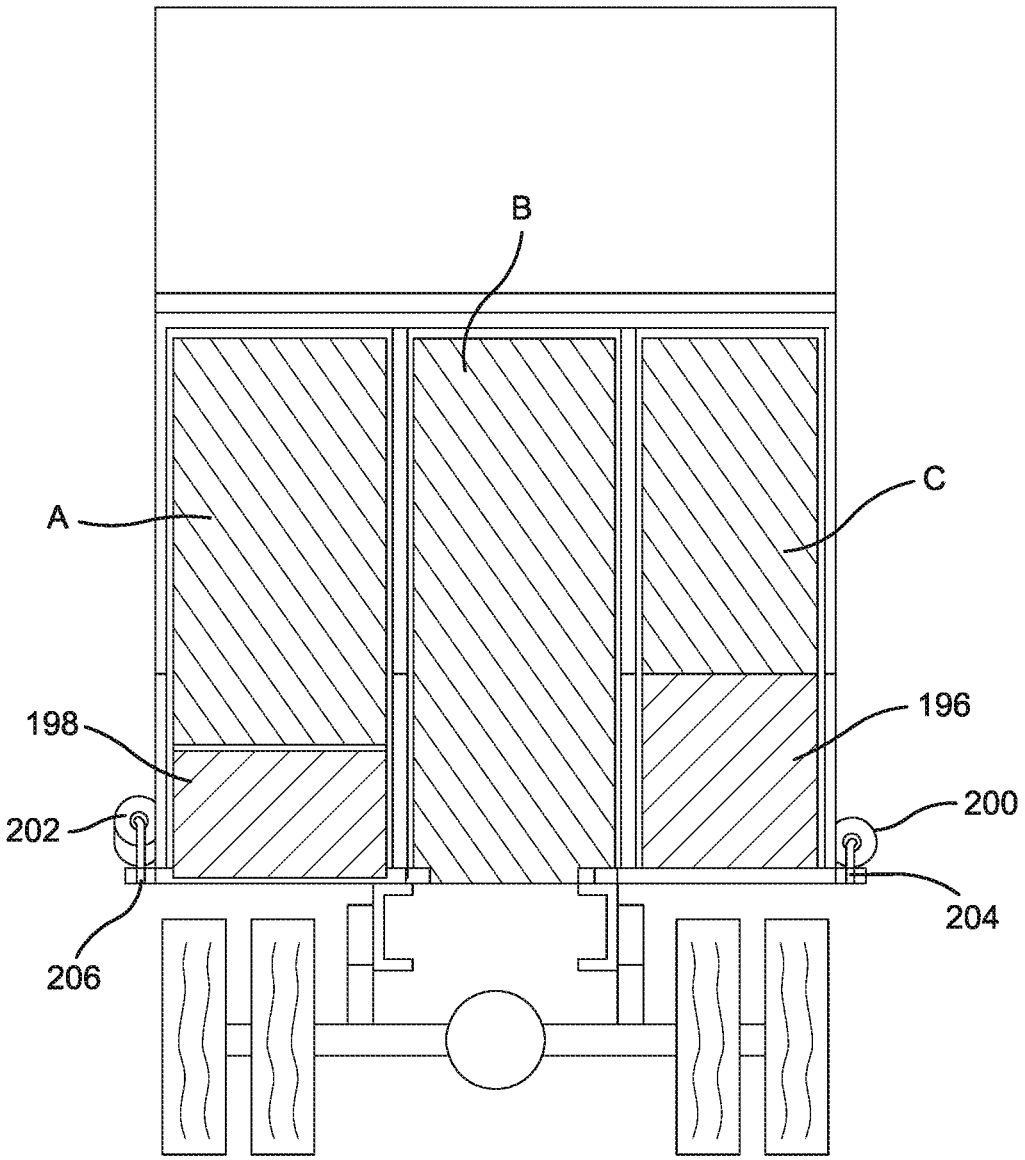
FIG. 8 is a view of the open rear of the truck corresponding to FIG. 7, showing the anti-spill plates.

FIGS. 6-8 show an improved compaction unit 182 that can be used with any type of multi-compartment refuse packer to address this problem. The compaction unit 182 has an upper portion 184 pivotally connected at 186 to the upper portion of the main body 188 of the truck and a lower portion 190 that extends downwardly behind the main body of the truck and defines the sumps. The pack blade is located within the upper portion 184 and the sweep blade is located in the lower portion 190. During collection, the pack blade runs up and down along oblique track 192, which enables the path of the pack blade (described previously) to follow the similarly oblique edges 194*a* at the openings of the upper portion of the compartments of the main body of the truck. The upper edges 194*a* extend backward and downward from the area of the pivot 186. The lower edges 194*b* at the lower portion of the openings angle downward and forward from the lower end 194*c* of the upper edges. Two anti-spill plates 196, 198 at the bottom of the sump with associated hydraulic actuators 200,202 and linkages 204, 206 are provided for the two outer compartments.

When the truck is full and ready to unload (FIG. 6), the sweep blade is opened (extended). The anti-spill plates are rotated into the up (closed) position, and the compaction unit is raised (FIG. 7). The two anti-spill plates hold the contents within the outside compartments, thus enabling the center compartment to be ejected first. Spillage would tend to occur at the floors of the compartments, but this is prevented by the blocking effect of the anti-spill plates. Each anti-spill plate confronts or slightly enters the lower portion of a compartment opening, defined by the edges 194*b*. This blocks the lower portion of the opening, while the packed refuse at the upper portion of each compartment opening has a natural angle of repose corresponding to the angle of the back edges 194*a* resulting from the operating angle of the pack blade. The anti-spill plates need only block the lower portion, which is preferably less than half of the full height of the compartment openings. Whereas the sweep blades pivot counterclockwise toward the openings, the anti-spill blades pivot clockwise toward the openings.

Once the center compartment is unloaded, each of the outside compartments is uncovered in turn by lowering the respective anti-spill plate. FIG. 8 shows the back of the truck during the load ejection sequence of compartments A, B, and C, with the center compartment B fully open, compartment A during opening of the anti-spill plate, and compartment C with the anti-spill plate fully closed.

It should be understood that the anti-spill plates are inside the respective sumps, below the sweep path of the sweep blades when the compaction unit is in the collection position. Each anti-spill plate is displaceable out of the sump for confronting the bottom of the associated refuse compartment when the compaction unit is pivoted to the ejection position.

Figure 9:
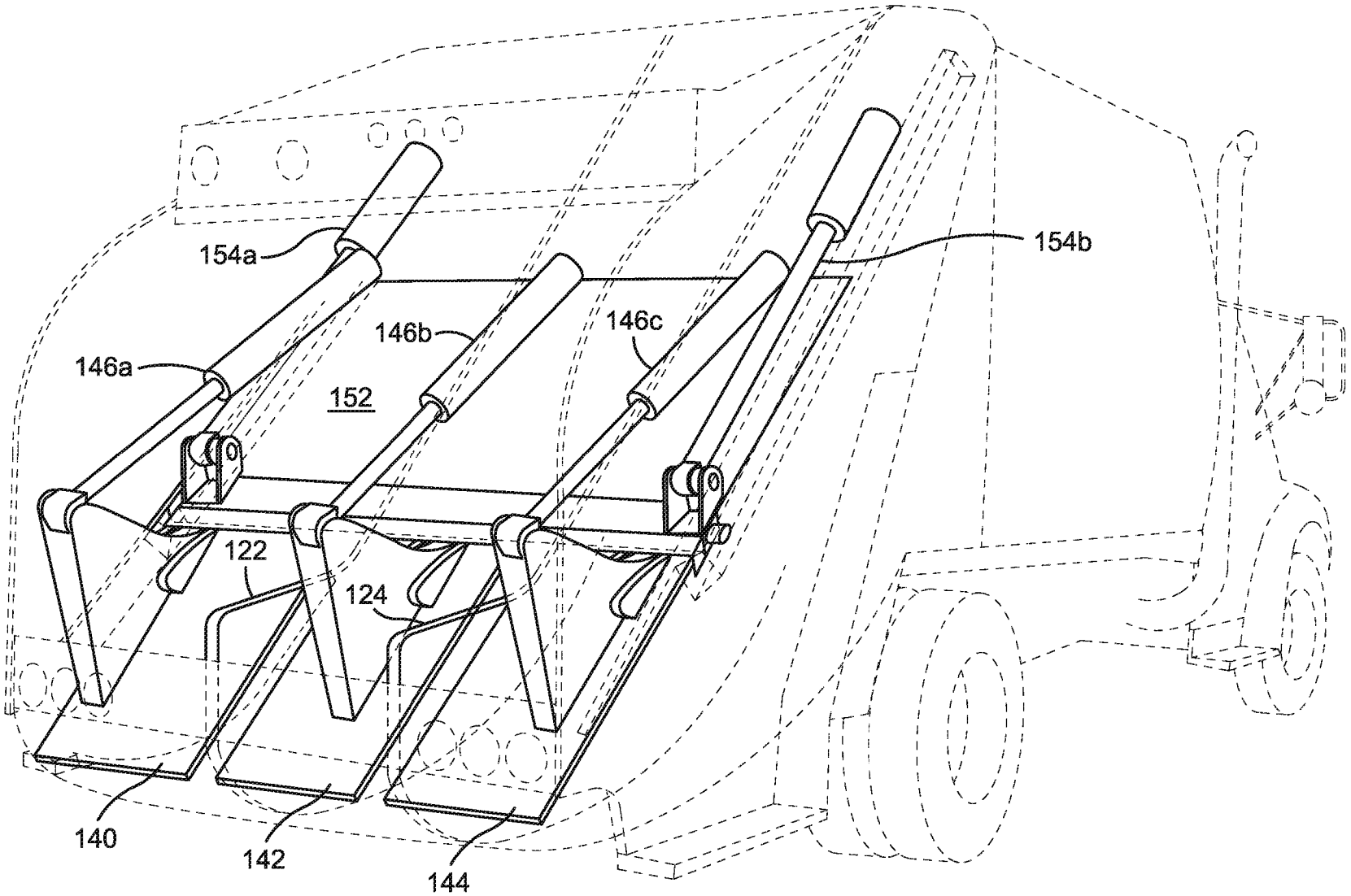
FIG. 9 is a perspective view of the sweep blade, pack blade, and associated drive systems corresponding to position 2 in FIG. 2.
Figure 10:
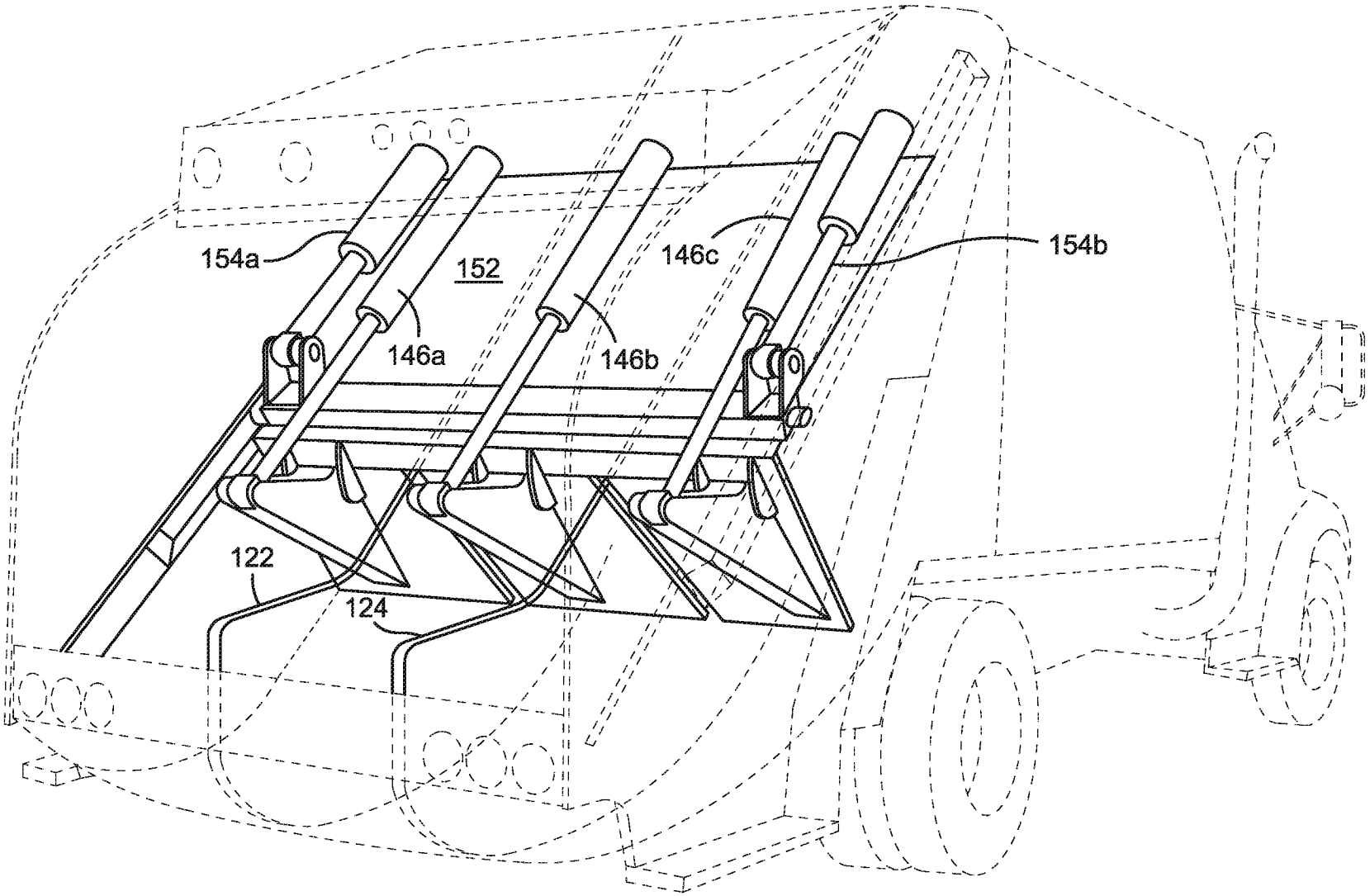
FIG. 10 is a perspective view of the sweep blade, pack blade, and associated drive systems corresponding to position 4 in FIG. 2.

FIGS. 9 and 10 are perspective views of the sweep blade, pack blade, and associated drive systems corresponding to the respective positions 2 and 5 shown in FIG. 2, consistent with FIG. 3 and representative of a unitary or segmented sweep blade as shown in FIGS. 4 and 5.

Figure 12:
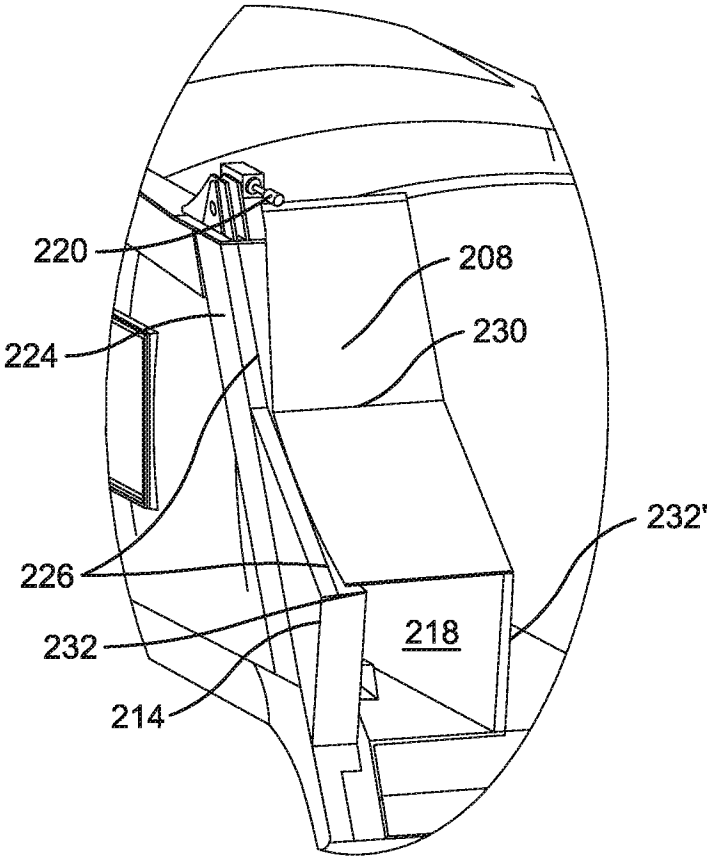
FIG. 12 corresponds to FIG. 11, with the seal plate closed and the anti-spill plate open.
Figure 11:
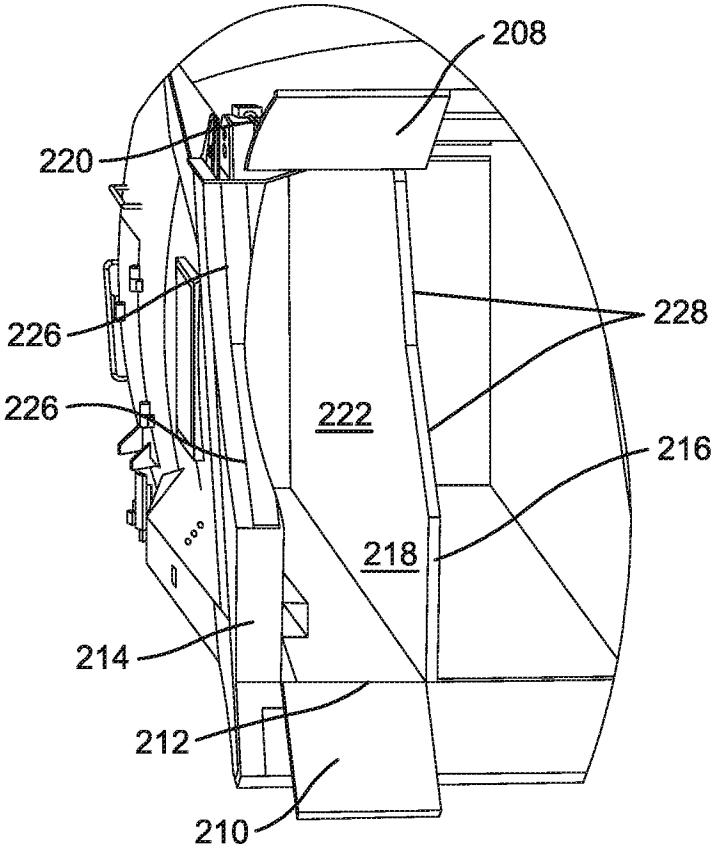
FIG. 11 shows a fully open compartment at the back driver's side of the truck body that incorporates a seal plate with the anti-spill plate.

FIGS. 11 and 12 show an additional preferred feature, whereby the inadvertent spilling of the content of each side compartment can be further prevented during unloading. In a manner analogous to the anti-spill plates, a seal plate 208 is provided for each side compartment, such that the seal plates prevent the content from overflowing the top edge of the anti-spill plates 210. Whereas the anti-spill plates pivot 212 from a low point at the back of the body upwardly toward the compartment end walls 214, 216, and close a lower portion or region 218 of the compartment opening, the seal plates 208 pivot 220 from a high point at the back of the body downwardly toward the compartment end walls, closing an upper portion or region 222 of the opening. When deployed together during unloading of a given compartment, each pair of vertically opposed set of anti-spill plate 210 and seal plate 208 effectively block the entire rear opening of the compartment that is not being unloaded.

The back of the body is shown with angled profile 224 with an edge that can be fitted with resilient seals such as outer seal 226 and inner seal 228. A straight (or as shown) correspondingly angled 230 seal plate 208 is pivotally connected with a drive system at the top, or near the roofline of the body. The outer seal 226 can be a strip, ridge, ledge or shaped plate fixed to the body whereas each of the two inner seals 228 would generally be a strip covering the two edges of the central compartment walls. The seal plate 208 extends over the upper region of the opening, down to the tops 232, 232' of the vertical outer body support and vertical portion of the internal divider wall, which defines the lower region.

Figure 13:
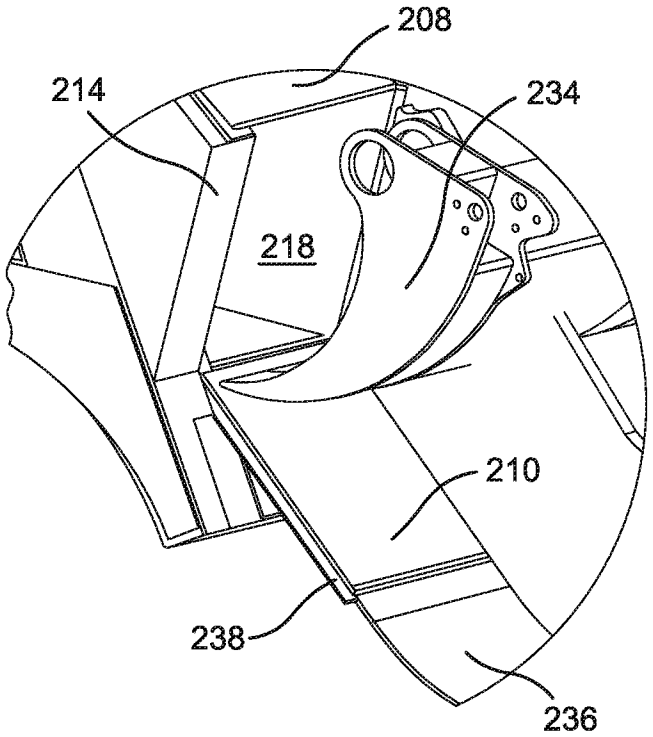
FIG. 13 corresponds to FIG. 12, during the refuse collection mode of operation, whereby the sweep blade pushes material toward the open lower region of the compartment.
Figure 14:
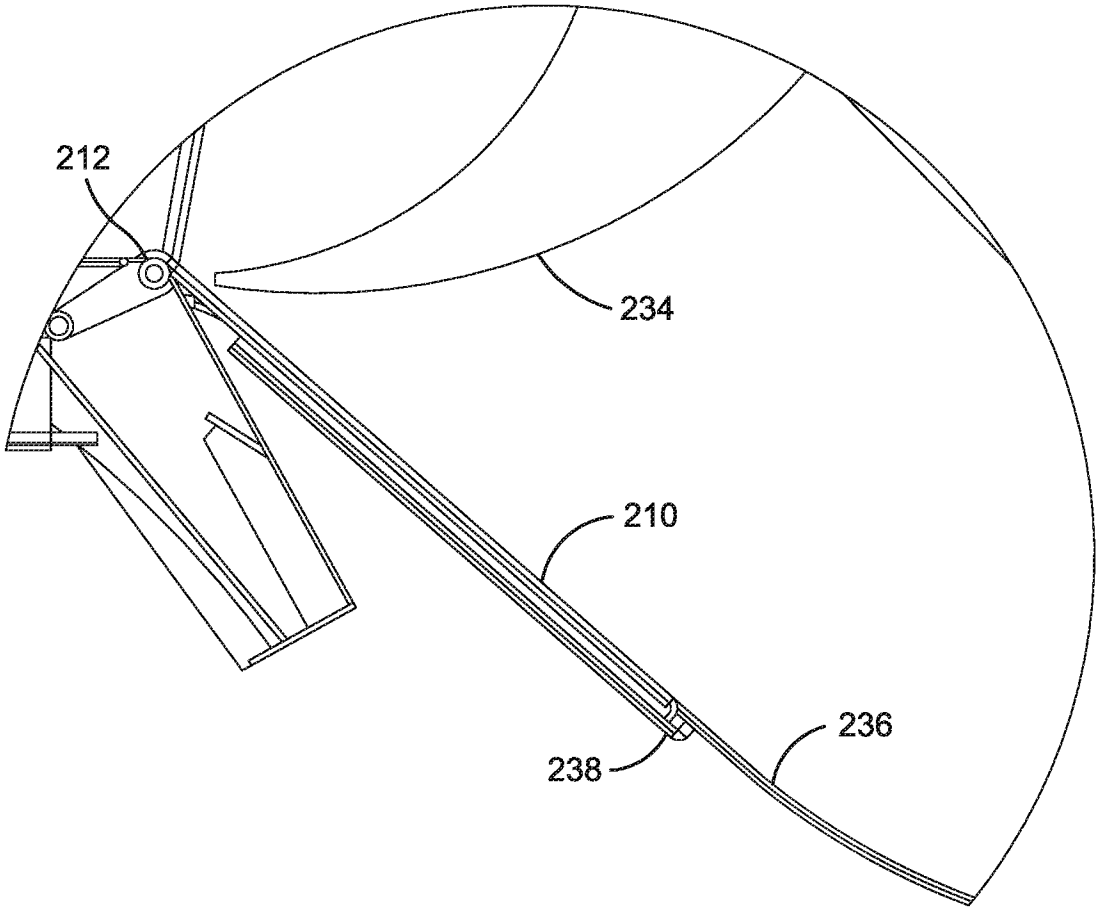
FIG. 14 corresponds to FIG. 13, in a detailed view of the sweep blade passing over the anti-spill plate.

When the compaction unit is lifted, each lateral compartment thus has a rear opening with upper and lower regions. The upper region is subject to closure with the sealing plates and the lower region is subject to closure with the anti-spill plates, thereby preventing spillage while the central or other lateral compartment is being unloaded. As shown in FIGS. 13 and 14, during the compaction phase, the seal plates 208 are closed whereas the anti-spill plates 210 are open, to maintain an open lower region of the compartment for the sweep blade 234 and pack blade (not shown) to operate. In the packing phase, the hopper pan portion 236 of the sump has a recessed lower plate 238 that supports the flat, overlying, open anti-spill plate 210, so the sweep blade passes closely over the anti-spill plate toward the open lower region of the compartment. The seal plates are closed, but the pack blade (not shown) can push refuse through the open lower region.

Figure 15:
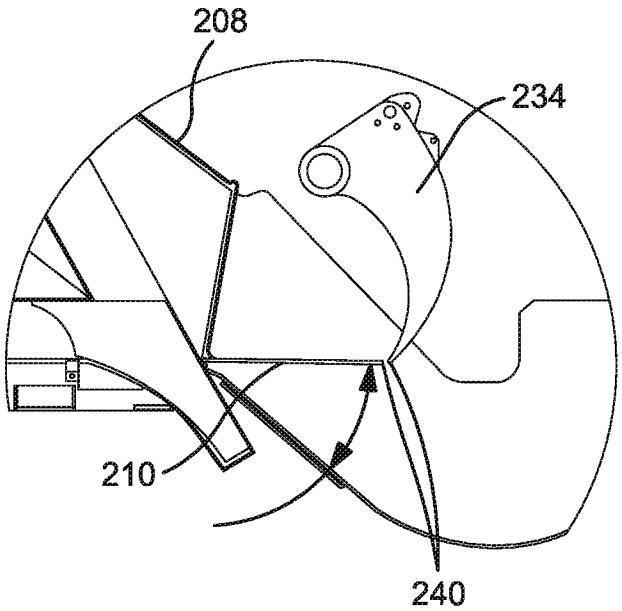
FIGS. 15 and 16 show how the sweep blade pivots away to provide clearance for the anti-spill plate to pivot upwardly toward the lower region of the compartment opening in preparation for dumping another compartment.
Figure 17:
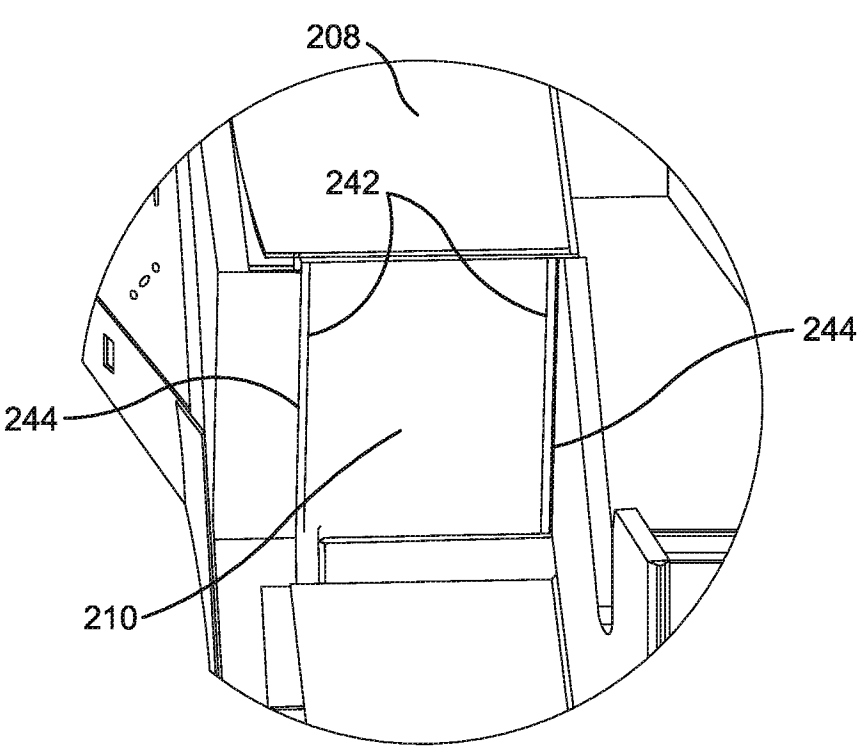
FIG. 17 shows the anti-spill plate and seal plate in the closed positions.
Figure 16:
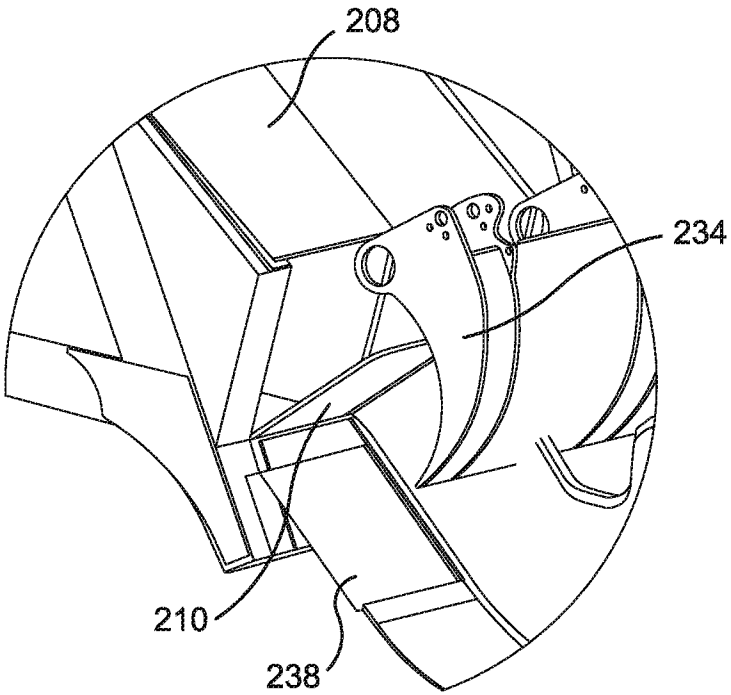

FIGS. 15-17 show the cooperation of the seal plates 208 and anti-spill plates 210 during the transition to the dumping phase, wherein initially, at least the lateral compartments must be closed as the compaction unit is raised. For one of the lateral compartments, the corresponding sweep blade 234 pivots or is otherwise angularly displaced from the packing position as shown in FIG. 14, to a dump position as shown in FIG. 16. At that point, the anti-spill plate 210 can be fully closed, as shown in FIG. 17.

In a three-compartment system, when the compartments are to be emptied, generally the central compartment is emptied first, while the lateral compartments are both sealed with the closed seal plates and closed anti-spill plates, as shown in to FIG. 17. During the transition to the dumping phase, the anti-spill plate pivots toward and closes off the lower region of the compartment opening as the sweep blade retracts. Preferably, the lateral edges of the anti-spill plate are provide with flexible wipers 242 to bear upon the inner edges 244 of body wall structure that define the lower region of the opening. As shown in FIG. 15 these movements are coordinated to avoid interference by providing clearance 240. After dumping from the central compartment, the equipment moves to another dump location and the seal plate and anti-spill plate of one lateral compartment are opened for dumping, as shown in FIG. 11, while the other compartment remains closed. The equipment is then moved whereupon the other compartment is fully opened.

As an alternative, the seal plates could be simply hinged, with each being heavy enough to stay closed and only open as a result of the pressure of the contents being pushed out the back end by the hydraulic ram.

It should be understood that a similar need for preventing spillage arises in a two-compartment or even four-compartment system. The anti-spill plates and sealing plates as described above can be readily implemented into any refuse body having multiple (at least two) compartments.

The invention claimed is:

1. A collection assembly for a refuse truck body, comprising:

a truck body having a front and a back, and at least two refuse compartments accessible through compartment openings at the back of said truck body;

a compaction unit pivotally connected to the back of the truck body at a pivot connection with an actuator for pivoting the compaction unit between a collection position confronting the refuse compartments and an ejection position that exposes the refuse compartments;

wherein said compaction unit includes at least two collection sumps, each associated with a respective refuse compartment for receiving refuse;

a sweep blade having a section for each collection sump;

a first drive system for moving the sweep blade sections through the collection sumps when the compaction unit is in the collection position;

a single pack blade pivotally connected to the sweep blade;

a second drive system operatively connected to the pack blade for moving the pack blade and connected sweep blade toward the compartment openings to thereby push the refuse through the compartment openings while maintaining segregation of the refuse; and at least one anti-spill plate supported by the body and situated within a respective sump and selectively moveable for confronting the associated refuse compartment when the compaction unit is in the ejection position.

2. The collection assembly of claim 1, wherein the anti-spill plate is inside the sump, below a sweep path of the sweep blade when the compaction unit is in the collection position and is displaceable out of the sump for confronting a lower portion of the associated refuse compartment when the compaction unit is pivoted to the ejection position.

3. The collection assembly of claim 2, wherein the truck body has a central and two outer refuse compartments, with a respective center and two outer sumps, and each outer sump has an associated anti-spill plate.

4. The collection assembly of claim 2, wherein the compartments have angled back edges that extend back and downward from an area of the pivot connection and then forward and downward, thereby defining respective upper and lower portions of the compartment openings;

when viewed from a direction in which the sweep blades pivot counterclockwise toward the lower portion of the compartment openings, the anti-spill plates pivot clockwise toward the lower portion of the compartment openings.

5. The collection assembly of claim 1, wherein the truck body has three refuse compartments extending longitudinally from the front toward the back of the body, with each compartment having a rear opening;

the compaction unit comprising;

three collection sumps at the back of the body, situated rearward of and below the compartment openings, for receiving a respective three loads of segregated refuse;

two laterally spaced divider walls extending from the sumps to the compartment openings, thereby defining two outer and one central loading channel from the sumps to the compartments; and said sweep blade extends laterally across all the sumps, with three sections corresponding to the three collection sumps, wherein the sweep blade sections are movable respectively within each sump;

an anti-spill plate is operatively associated with a respective outer loading channel, displaceable between an open position away from the loading channel and a closed position against the respective compartment opening.

6. The collection assembly of claim 5, wherein an anti-spill plate is inside each outer sump, below a sweep path of the sweep blade, for blocking a lower portion of outer refuse compartments while a center compartment is unloaded.

7. The collection assembly of claim 6, including a third drive system mounted at an exterior of the body, for actuating the anti-spill plates.

8. The collection assembly of claim 1, wherein the compartments have angled back edges that extend back and downward from an area of the pivot connection and then forward and downward, thereby defining respective upper and lower portions of the compartment openings;

when viewed from a direction in which the sweep blades pivot counterclockwise toward the lower portion of the compartment openings, the anti-spill plates pivot clockwise toward the lower portion of the compartment openings.

9. The collection assembly of claim 1, wherein each compartment opening has an upper region and a lower region;

the anti-spill plate associated with said at least one sump is displaceable to cover the lower region of the opening;

a seal plate is mounted on the body in vertical opposition to each anti-spill plate, to selectively cover the upper region of the opening;

whereby the anti-spill plate and the seal plate confront and close the compartment opening of the associated refuse compartment when the compaction unit is pivoted to the ejection position.

10. The collection assembly of claim 9, wherein the seal plate is pivotally mounted to a top of the back of the truck body.

11. The collection assembly of claim 1, wherein the truck body has three refuse compartments extending longitudinally from the front toward the back of the body, with each compartment having a rear opening;

the compaction unit comprising;

three collection sumps at the back of the body, situated rearward of and below the compartment openings, for receiving a respective three loads of segregated refuse; and two laterally spaced divider walls extending from the sumps to the compartment openings, thereby defining two outer and one central loading channel from the sumps to the compartments, wherein each divider wall has a back portion with a top edge extending forward along adjacent sumps and a front portion with a top edge that rises obliquely from the top edge of the back portion to ceilings of the respective refuse compartments.

12. A refuse truck having a refuse receiving body including a front, a back, a top, and a bottom, with at least one refuse compartment with an opening accessible at the back of the body, comprising;

an anti-spill plate supported by the body, and rotatable between an open position away from a lower region of the opening of said at least one compartment and a closed position against the lower region of the opening of said at least one compartment;

a seal plate supported by the body, and rotatable between an open position away from an upper region of the opening of said one compartment and a closed position against the upper region of the opening of said at least one compartment; and a sweep blade proximate the anti-spill plate and the seal plate, wherein the sweep blade comprises a section corresponding to the at least one compartment, wherein the sweep blade is configured to rotate towards the opening of said at least one compartment, and wherein the section of the sweep blade is configured to move through a collection sump associated with the at least one compartment.

13. The refuse truck of claim 12, wherein the anti-spill plate is pivotally supported at the bottom of the back of the body; and the seal plate is pivotally supported at the top of the back of the body;

whereby when the anti-spill plate and the seal plate are both in the respective closed positions, the opening of said at least one compartment is closed.

14. The refuse truck of claim 12, wherein said refuse receiving body has a plurality of refuse compartments extending longitudinally from the front toward the back of the body, and one of said refuse compartments does not include an anti-spill plate or a seal plate.

15. The refuse truck of claim 12, wherein said opening extends from the top to the bottom of said refuse receiving body.

* * * * *